US011129474B2

(12) United States Patent
Marriott et al.

(10) Patent No.: US 11,129,474 B2
(45) Date of Patent: Sep. 28, 2021

(54) DRAWER FOR A STORAGE SYSTEM

(71) Applicant: Supply Point Systems Limited, Rugby (GB)

(72) Inventors: Christopher Marriott, Rugby (GB); Iain Clark, Rugby (GB); Brandon Warzecho, Raleigh, NC (US); Jeff Wittich, Cary, NC (US)

(73) Assignee: Supply Point Systems Limited, Warwickshire (GB)

( * ) Notice: Subject to any disclaimer, the term of this patent is extended or adjusted under 35 U.S.C. 154(b) by 0 days.

(21) Appl. No.: 16/647,469

(22) PCT Filed: Sep. 14, 2018

(86) PCT No.: PCT/GB2018/052630
§ 371 (c)(1),
(2) Date: Mar. 13, 2020

(87) PCT Pub. No.: WO2019/053455
PCT Pub. Date: Mar. 21, 2019

(65) Prior Publication Data

US 2020/0275778 A1 Sep. 3, 2020

(30) Foreign Application Priority Data

Sep. 15, 2017 (GB) ..... 1714921

(51) Int. Cl.

| | |
|---|---|
| ***A47B 88/00*** | (2017.01) |
| ***E05B 65/46*** | (2017.01) |
| ***A47B 88/975*** | (2017.01) |
| ***A47B 88/42*** | (2017.01) |
| ***G07F 11/62*** | (2006.01) |
| ***G07F 17/00*** | (2006.01) |

(52) U.S. Cl.
CPC ..... *A47B 88/975* (2017.01); *A47B 88/42* (2017.01); *G07F 11/62* (2013.01); *G07F 17/0092* (2013.01); *A47B 2088/421* (2017.01)

(58) Field of Classification Search
CPC ... G07F 17/0092; G07F 11/62; A47B 88/975; A47B 88/90; A47B 88/994; A47B 88/42
See application file for complete search history.

(56) References Cited

U.S. PATENT DOCUMENTS 3,656,651 A 4/1972 Hage
4,436,215 A * 3/1984 Kleinert ..... B65D 25/06 220/533

(Continued)

FOREIGN PATENT DOCUMENTS

AT 239755 B * 4/1965 ..... B42F 17/02
DE 8808466 U1 * 10/1988 ..... A47B 88/90

(Continued)

*Primary Examiner* — Kimberley S Wright
(74) *Attorney, Agent, or Firm* — Kagan Binder, PLLC

(57) ABSTRACT

A drawer (100) comprising at least one receptacle (103) open at the top of the drawer; a drawer information means extending in a depth direction of the drawer, wherein the drawer information means comprises a series of projections (108) moulded into the drawer. The drawer also comprises guiding slots (104) for holding an insert (400) having a plate (401); and a pair of legs (404*a*, 404*b*) formed in the body of the plate and extending longitudinally upwards along the sides of the plate.

12 Claims, 7 Drawing Sheets

(56) References Cited

U.S. PATENT DOCUMENTS

| | | | | | |
|---|---|---|---|---|---|
| 4,577,773 | A * | 3/1986 | Bitel | A47B 88/994 | 220/533 |
| 4,616,890 | A * | 10/1986 | Romick | E05B 65/462 | 312/216 |
| 6,039,467 | A * | 3/2000 | Holmes | G16H 20/13 | 700/231 |
| 9,492,012 | B2 * | 11/2016 | Morgan | A47B 88/90 | |
| 10,269,205 | B2 * | 4/2019 | McFarland | G07F 11/18 | |
| 10,403,080 | B2 * | 9/2019 | Morgan | G07F 17/0092 | |
| 2002/0165641 | A1 * | 11/2002 | Manalang | A61G 12/001 | 700/237 |
| 2009/0045030 | A1 | 2/2009 | Peart | | |
| 2009/0224638 | A1 | 9/2009 | Weber | | |
| 2013/0069498 | A1 * | 3/2013 | Morgan | A47B 88/90 | 312/107 |
| 2017/0092035 | A1 * | 3/2017 | Morgan | A47B 88/90 | |

FOREIGN PATENT DOCUMENTS

| | | | | |
|---|---|---|---|---|
| DE | 8808467 | U1 * | 10/1988 | A47B 88/994 |
| DE | 9411155 | U1 * | 9/1994 | |
| FR | 2468335 | A1 | 5/1981 | |
| WO | WO-2018192703 | A1 * | 10/2018 | |

* cited by examiner

DRAWER FOR A STORAGE SYSTEM

CROSS REFERENCE TO RELATED APPLICATIONS

This application is a national phase application and claims priority to international application PCT/GB2018/052630, filed on Sep. 14, 2018, and entitled DRAWER FOR A STORAGE SYSTEM, the disclosure of which is incorporated herein by reference.

The present invention relates to drawers used in storage systems and apparatuses for supplying articles. Their use in stock control systems is well-known, for example in manufacturing facilities and medical facilities. They are also suitable for use as vending machines.

In typical automated stock control systems, a housing comprises a plurality of latched drawers. Articles to be supplied to users are provided in the drawers or compartments of the drawers. Examples of such articles include cutting tools and the like used with machine tools; other manufacturing tools and components; drugs, needles and other medical items; and legal documents. A control system allows a user to access the required article by unlatching the drawer containing the required article. The drawer is then pulled out from the home position (where no compartments are exposed) to the extent that the compartment containing the article is exposed, when the drawer is latched again to prevent further opening of the drawer.

In such systems, a raster strip is often fitted to the drawers. The raster strip is a metal bar with holes cut out at predetermined intervals. By means of the raster strip and sensors provided adjacent the drawer, it is possible to determine whether the drawer is in the home position and, if not, how far from the home position it has moved, how fast it is moving and in which direction it is moving.

In known systems, the raster strip is a metal component mounted onto each drawer by means of screws. However, installing such an additional component adds to the cost and complexity of the system. Especially in a system with several drawers, providing such a strip on each drawer is cumbersome and cost-intensive. Therefore, there exists a need for a simpler and more cost-effective way to monitor the movement of the drawers in an inventory supply system.

Furthermore, in such systems, each drawer includes a number of compartments separated by compartment walls. Such compartments are useful when the articles stored in the compartments are small and fiddly, such as medicinal tablets or small components such as screws, washers and so forth. However, the compartment walls are often moulded into the drawer and therefore fixed. Therefore, the size of the compartments cannot be changed. There is no option for a user to store articles of different shapes and sizes in such drawers. If a large-sized article is to be stored, a new drawer with larger compartments would need to be installed. Although drawers with removable compartment walls are known, they are often flimsy and can be easily tampered with. Therefore, there exists a need for drawers with re-configurable compartments without compromising on the rigidity and security provided by the fixed compartment walls.

Thus, the prior art system suffers the problem that modification to meet particular customer needs, for example by resizing and reconfiguring drawers, is difficult and expensive.

The present invention has been made to address the problems of the prior art system.

According to the first aspect of the present invention, there is provided an insert for dividing a drawer into compartments, said insert comprising:

a plate; and a pair of legs formed in the body of the plate and extending longitudinally upwards along the sides of the plate.

Preferably, the legs of the insert are sprung such that they bend inwards to aid insertion of the insert into guiding slots formed in the body of the drawer.

Preferably, the legs are adapted to engage with a pair of corresponding engagement holes provided on either side walls of the drawer when the plate is inserted into the guiding slots.

In this case, it is preferred that the legs extend up to mid-way along the length of either side of the plate.

Furthermore, it is preferred that the legs further comprise a corresponding pair of feet having a flat top and a sloped lower end.

Preferably, the insert further comprises at least one protrusion extending outwards from the base of the plate, wherein the protrusion is adapted to engage with a notch, provided on the bottom surface of the drawer, when the plate is inserted into the guiding slots.

It is preferred that the insert further comprises tapered ends extending longitudinally downwards from the top ends of the plate, above the legs, wherein the tapered ends project further outwards from the sides of the plate than the legs, and are adapted to securely glide and rest in corresponding top ends of the guiding slots.

Preferably, the insert is adapted to be removed from the drawer by guiding a removal means into the engagement holes so as to disengage the legs from the engagement holes.

According to another aspect of the invention, there is provided a drawer comprising:

a receptacle open at the top of the drawer;

at least one guiding slot extending longitudinally along an inner surface of a side wall of the drawer; and at least one engagement hole formed in the side wall of the drawer along the guiding slot, wherein the guiding slot is adapted to hold an insert which engages with the engagement hole and divides the drawer into at least two compartments.

According to yet another aspect of the invention, there is provided a drawer comprising:

at least one receptacle open at the top of the drawer; and a drawer information means extending in a depth direction of the drawer, wherein the drawer information means comprises a series of projections moulded into the drawer.

Preferably, the drawer information means further comprises a series of gaps formed between consecutive projections.

In this case, it is preferred that the gaps formed between consecutive projections are equidistant.

Preferably, the drawer information means is disposed between upper and lower-rail engaging means provided in a first side of the drawer and adjacent the upper rail-engaging means.

It is preferred that the drawer and the projections are injection moulded as one single unit.

According to another aspect of the present invention, there is provided an insert for a drawer comprising a plate and at least one leg integrally formed with the plate and extending longitudinally upwards along the side of the plate.

The various features of the insert and drawer of other aspects of the invention discussed above also apply to this aspect of the invention Embodiments of the present invention will now be described by way of example only and with reference to the accompanying drawings, in which.

Figure 1:
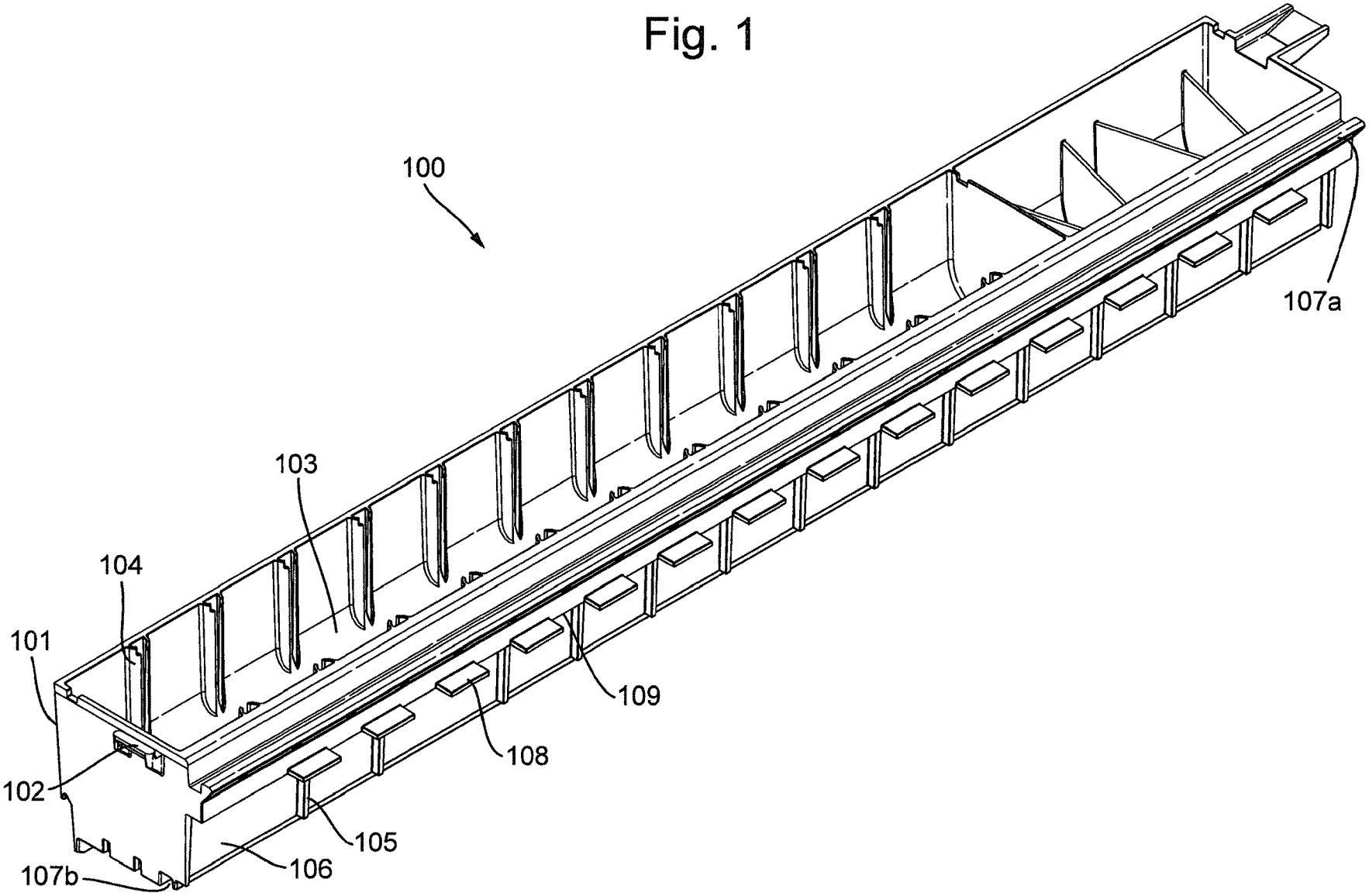
FIG. 1 is a perspective view of a drawer according to the present invention.

As shown in FIG. 1, a drawer 100 comprises a drawer main body 101 with a support 102 for mounting a handle thereto. The drawer main body 101 is formed as a single piece from a hard-plastic material such as ABS by injection moulding. The drawer main body 101 comprises a receptacle 103 open to the top and a plurality of guiding slots 104 formed inside the drawer main body 101. The drawer main body 101 further comprises a plurality of latch stops 105 corresponding the guiding slots 104 on the right-hand side wall 106 of the main body 101, which is the side that is mounted adjacent a guide block 205 (shown in FIG. 2).

The main body 101 also includes an upper rail-engaging portion 107*a* adapted to engage with a corresponding upper guide rail of the guide block 205. In addition, a groove is formed on the bottom of the drawer 100 adjacent the right-hand side wall 106 as a lower rail-engaging portion 107*b*.

A series of projections 108 are moulded into the drawer 100. In the present embodiment, the drawer main body 101 and projections 108 are injection moulded as one single unit. The projections 108 are formed along a depth direction of the drawer 100 between the upper and lower rail-engaging portions 107*a*, 107*b* and are disposed adjacent the upper rail-engaging portion 107*a*. The projections 108 are spaced at regular intervals thereby forming a series of gaps 109 therebetween. The series of projections 108 together with the series of gaps 109 define a means for providing information about the position and movement of the drawer 100, as explained below.

Figure 2:
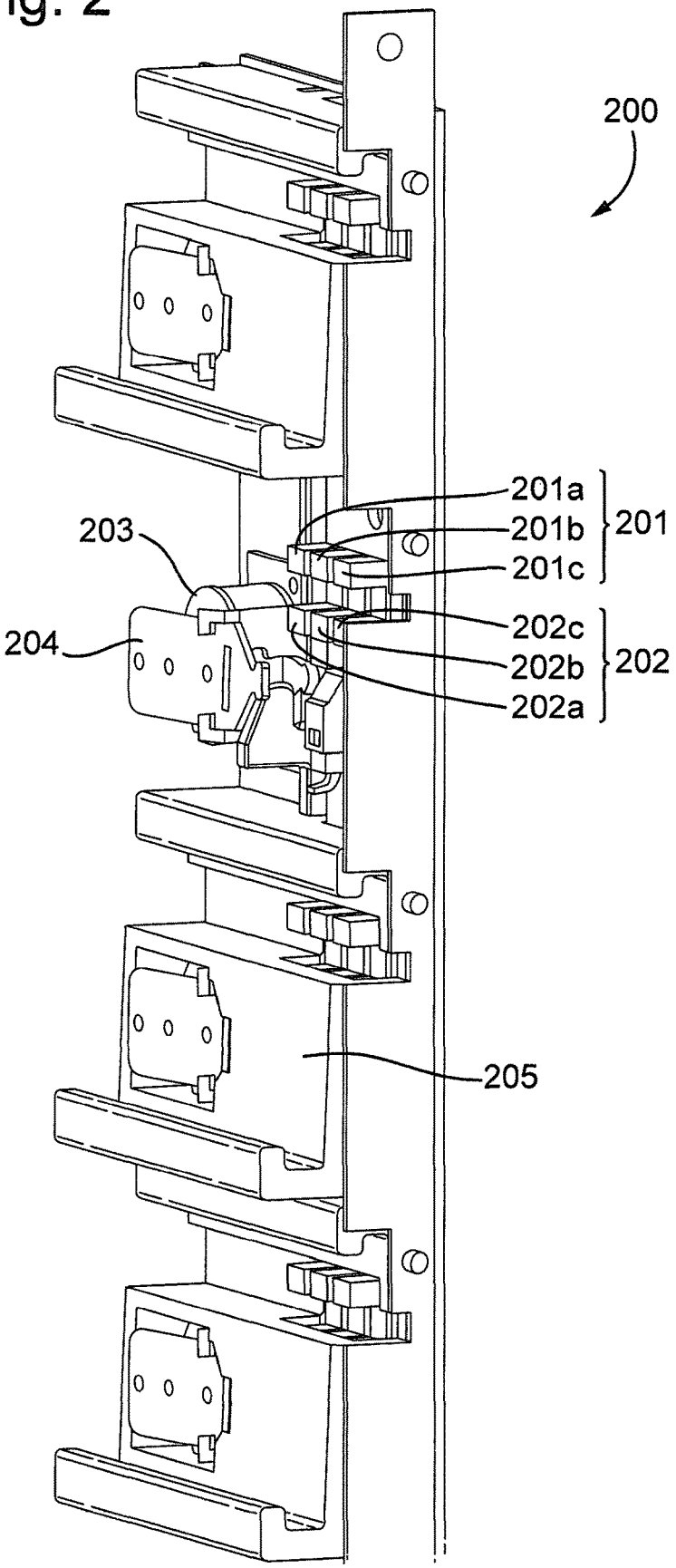
FIG. 2 is a perspective view of a cartridge with guide blocks for holding the drawer shown in FIG. 1.

FIG. 2 shows a perspective view of a cartridge 200 with its components. It should be noted that in FIG. 2, one guide block 205 has been removed for ease of reference. A guide block 205 is mounted over each sensor group 201, 202 and latch mechanism 203, 204. However, the guide block 205 is provided with windows to allow a solenoid flap 204 and LEDs 201 to protrude.

Now referring to FIGS. 1 and 2, the projections 108 are formed into the drawer 100 adjacent the upper rail-engaging portion 107*a* at a height such that, when the drawer 100 is mounted to a cartridge 200, the projections 108 and the gaps 109 are disposed in the channel between a row of LEDs 201*a*, 201*b*, 201*c* and a row of light receivers 202*a*, 202*b*, 202*c*. In this way, as the drawer 100 is opened and closed, the series of projections 108 and gaps 109 slide through this channel. As the drawer 100 moves, the projections 108 occlude light and the gaps 109 pass light emitted by the LEDs 201 so that the light received by the light receivers 202 changes with movement of the drawer 100. The gaps 109 are all the same size and are shorter than the row of sensors 201, 202, except for the gap in front of the foremost projection 108 (referred to as front gap), which is longer than the row of sensors 201, 202. The front gap is longer than the row of sensors 201, 202 so that none of the light from any of the LEDs 201 is occluded from the projections 108 when the drawer 100 is closed (that is, in the home position). Since the front gap is the only gap longer than the row of sensors 201, 202, it can be used to detect whether the drawer 100 is in the home position. The gaps 109 and the sensors 201, 202 are sized and spaced so that the pattern of occlusion as the drawer 100 is moved allows control circuitry to determine whether the drawer 100 is in the home position and, if not, how far from the home position it has moved, how fast it is moving and in which direction it is moving.

Figure 3:
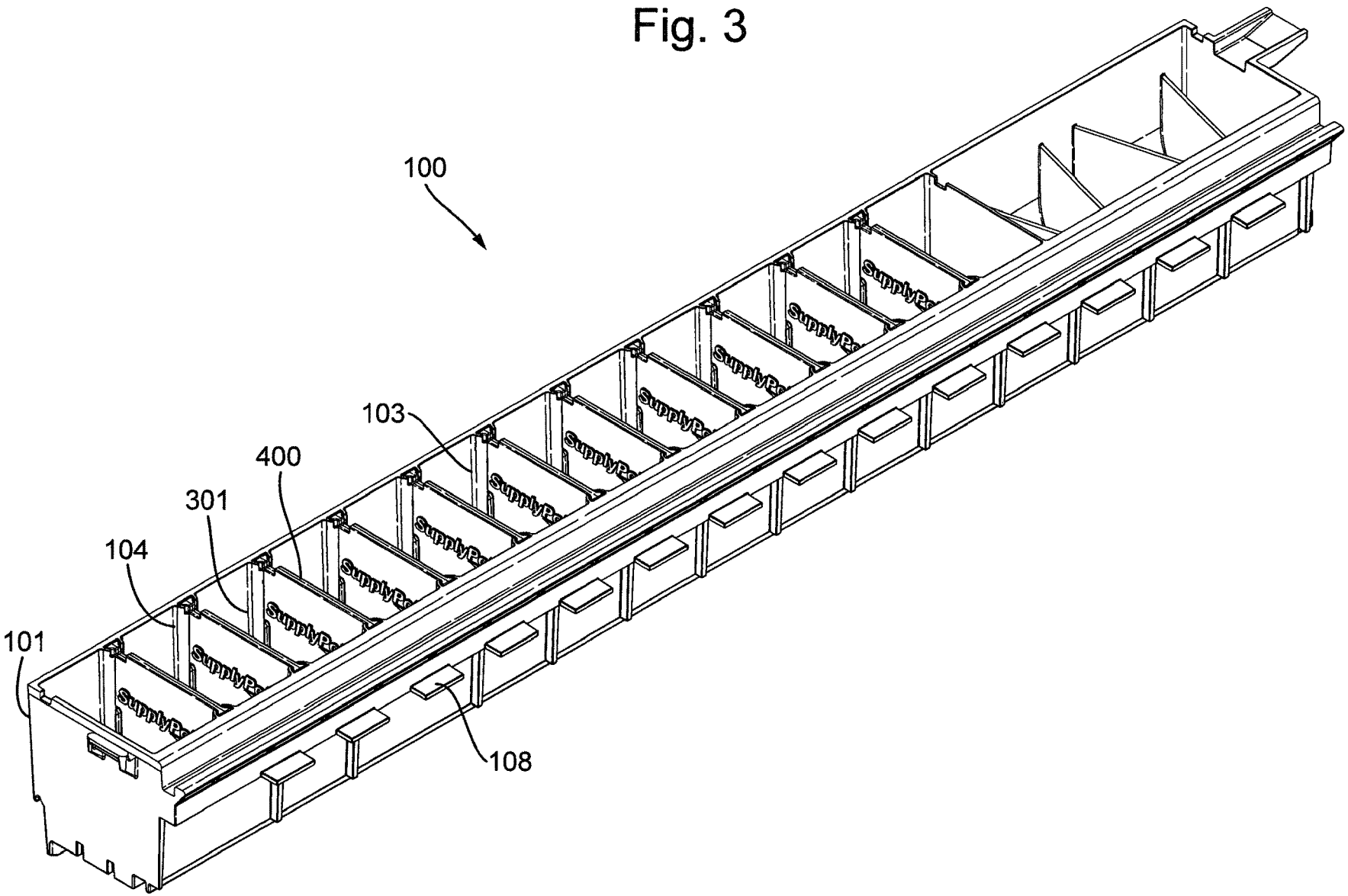
FIG. 3 is another perspective view of the drawer, shown in FIG. 1, with formed compartments.

Such information about the drawer movement can be used to control timing of activation of a solenoid 203 and thereby control a user's access to a particular compartment in the drawer 100. For example, if the drawer 100 is in the home position and it is decided to grant a user access to the third compartment 301 (as shown in FIG. 3) from the front of a drawer 100, information derived from the sensors 201, 202 can be used to control the solenoid 203 to retract the flap 204 until the drawer 100 is pulled out to the extent that the latch stop 105 corresponding to the second compartment has passed the backward facing edge of the flap 204, and then to release the flap 204; alternatively, the flap 204 may also be released earlier if it is determined that the drawer 100 is being opened at a sufficient speed. In this way, the user can remove any article(s) stored in the third compartment (as well as the first and second compartments). However, since he cannot pull the drawer 100 out further, he cannot access the compartments that are further back.

The arrangement described above for detecting the drawer 100 comprises three sensors, each comprising an LED emitter and a light receiver, acting together with a series of projections and gaps. However, other arrangements are envisioned, including the use of different numbers and types of sensors. For example, the sensors could comprise light emitting means and receivers adapted to detect light reflected from a series of projections 108 on the drawers 100. Alternatively, mechanical/electrical switch means opened or closed as the drawers 100 slide past, or RFID sensing means, could be used. Moreover, the sensors could be disposed on the drawer 100 and the projections could be formed on the guide block 205.

Figure 4:
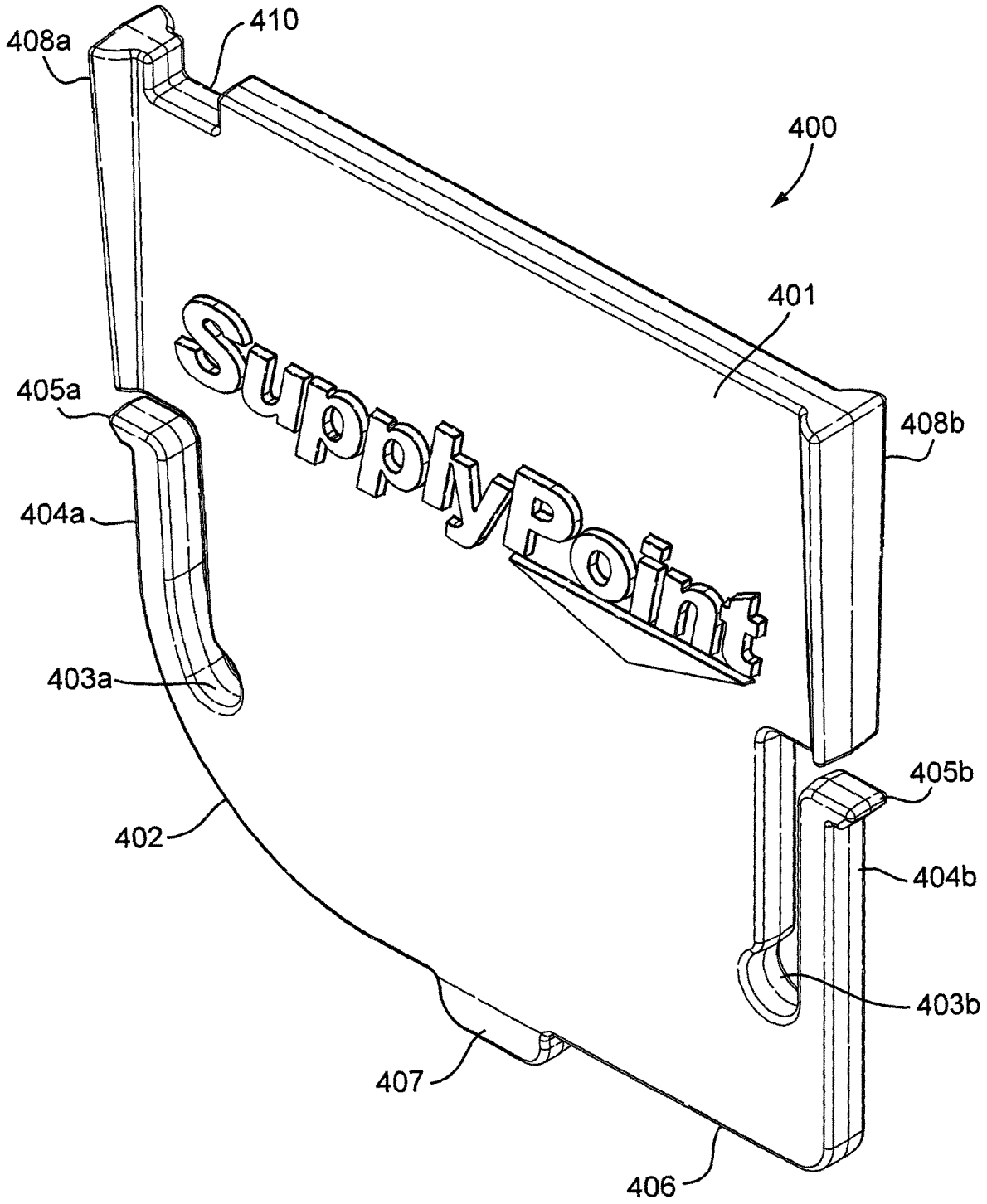
FIG. 4 is a perspective view of a drawer insert according to the present invention.

FIG. 4 shows a perspective view of a drawer insert 400 according to another aspect of the present invention. The drawer insert 400 comprises a plate 401, preferably formed as a single piece from a hard-plastic material by injection moulding. In the present embodiment, the plate 401 is substantially rectangular with one curved edge 402. However, it is to be understood that the plate 401 could be of any suitable shape and size. The plate 401 has cut-out sections 403*a*, 403*b* formed in both parallel vertical sides of the plate 401. Adjacent the cut-out sections 403*a*, 403*b* are legs 404*a*, 404*b* formed in the body of the plate 401 such that they extend longitudinally upwards from the vertical sides of the plate 401. The legs 404*a*, 404*b* are sprung by virtue of the cut-out sections 403*a*, 403*b* such that they bend inwards when subjected to external pressure. In the present embodiment, the legs 404*a*, 404*b* extend up to mid-way along the vertical sides of the plate 401. The legs 404*a*, 404*b* also comprise small protrusions extending laterally outwards;

these are referred to as feet 405*a*, 405*b*. The feet 405*a*, 405*b* are shaped such that they have a flat top and a sloped lower end.

The insert 400 further comprises tapered ribs 408*a*, 408*b* along its edges, the ribs being thicker than the plate 401 and extending longitudinally along the upper half of the vertical sides of the plate 401. The tapered ribs 408*a*, 408*b* have a wedge-shaped profile with thickness decreasing from upper to lower end. In the present embodiment, the tapered ribs 408*a*, 408*b* extend mid-way from the top along the vertical sides of the plate 401, above the legs 404. Therefore, the plate 401 is formed such that each vertical side is split into two halves, the lower half comprising the legs 404*a*, 404*b* and the upper half comprising the tapered ribs 408*a*, 408*b*. The tapered ribs 408*a*, 408*b* form an overhang over the legs 404 by virtue of the cut-out sections 403*a*, 403*b* and project slightly further outwards from the sides of the plate 401 than the legs 404*a*, 404*b*. It is to be understood that other arrangements for the legs and the tapered ribs are possible, e.g. the legs 404*a*, 404*b* could extend one-third along the length of the vertical sides and the tapered ribs 408*a*, 408*b* could extend along the remaining two-thirds or a different third. In addition, the tapered ribs 408*a*, 408*b* need not overhang the legs entirely but may only form a partial overhang.

The insert 400 also comprises a protrusion 407 extending outwards from the base 406 of the plate 401. In the present embodiment, the protrusion 407 is formed mid-way along the base 406. Furthermore, the insert 400 also comprises a guidance notch 410 formed in the top of the plate 401. In the present embodiment, the guidance notch 410 is formed in the left-hand side top corner of the plate 401.

Figure 5:
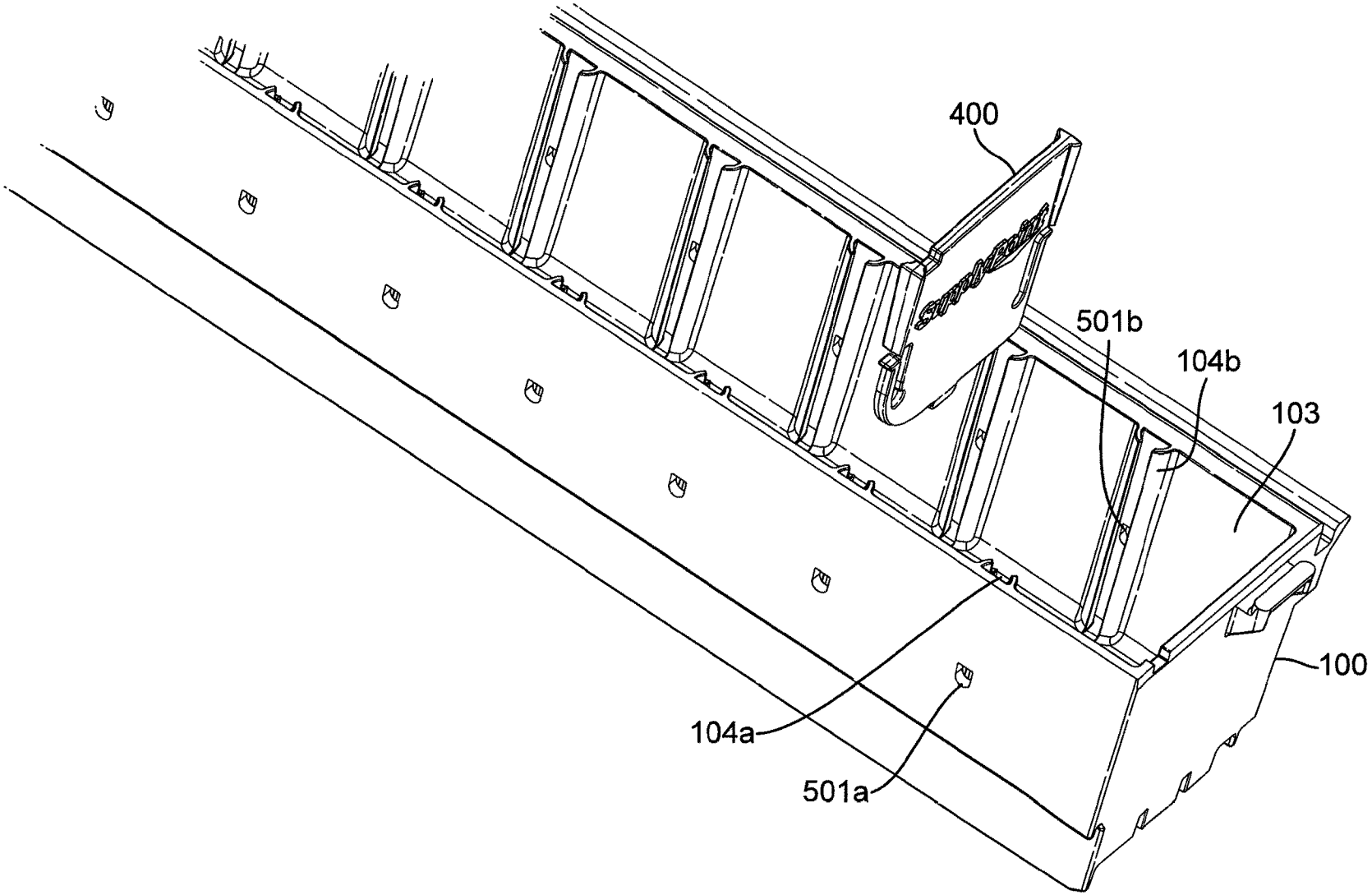
FIG. 5 is a perspective view of the drawer with the drawer insert, shown in FIG. 4, being inserted.

FIG. 5 shows a perspective view of the drawer 100 with the insert 400 being inserted. The drawer 100 comprises the receptacle 103 with a series of guiding slots 104 extending in a depth direction along the inner surface of the side walls of the drawer 100. In the present embodiment, the guiding slots 104 are equidistant from one another. Each pair of guiding slots 104*a*, 104*b* is adapted to hold the insert 400. The drawer 100 also comprises a series of engagement holes 501 extending in the depth direction along the side walls of the drawer 100. The engagement holes 501 are contained inside the guiding slots 104 and are disposed mid-way along the length of the guiding slots 104. Therefore, a pair of engagement holes 501*a*, 501*b* corresponds to a pair of respective guiding slots 104*a*, 104*b*.

Figure 6:
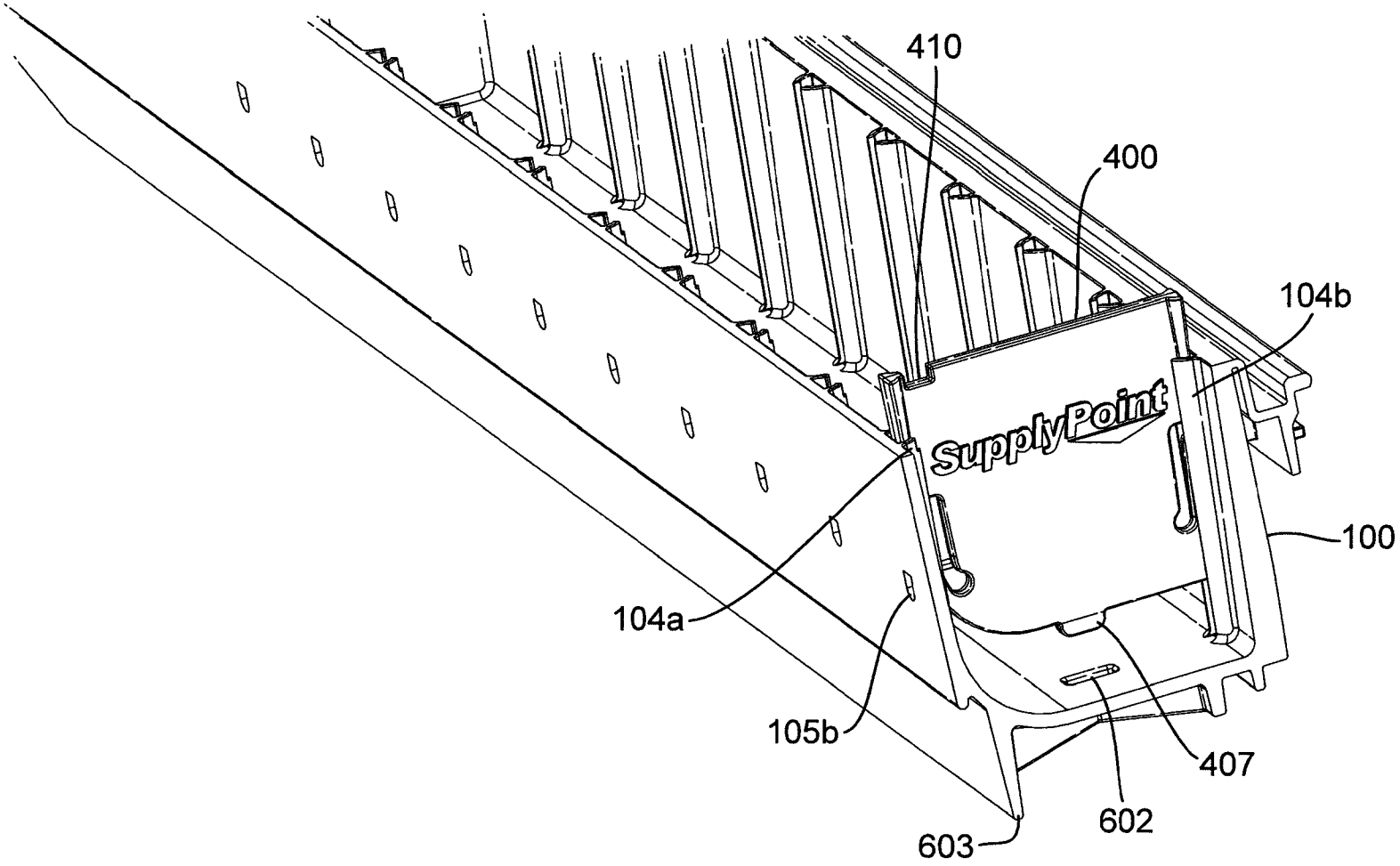
FIG. 6 is another perspective view of the drawer with the drawer insert, shown in FIG. 5, partially inserted.

Referring now to FIG. 6, the drawer 100 further comprises a series of notches 602 extending in the depth direction along the bottom surface of the drawer 100. In the present embodiment, the notches 602 are formed in the middle of the bottom surface of the drawer 100. The number of notches 602 in the drawer 100 equals the number of pair of guiding slots 104*a*, 104*b* in the drawer 100. Therefore, each notch 602 corresponds to a pair of respective guiding slots 104*a*, 104*b*.

The drawer 100 in its original form is not compartmentalised, and may be used as such to store very large articles of same type. However, in routine use, it is highly desirable for the drawer 100 to have compartments to store different types of articles of varying shapes and sizes. Therefore, the drawer 100 with the guiding slots 104 can be configured to have a desirable number of compartments using one or more drawer inserts 400. A user can easily push the insert 400 into the guiding slots 104*a*, 104*b* in the drawer 100 to form such compartments. The geometry and dimensions of the guiding slots 104*a*, 104*b* and the insert 400 are matched such that the insert 400 is securely held into place into the guiding slots 104*a*, 104*b*, as explained below.

Referring to FIGS. 5 and 6, when the insert 400 is pushed from the top into the guiding slots 104*a*, 104*b*, the legs 404*a*, 404*b* of the insert 400 are bent inwards due to a resistance provided by the rigid side walls of the drawer 100. Bending of the legs 104*a*, 104*b* aids sliding of the insert 400 into the guiding slots 104*a*, 104*b*. Moreover, as the feet 405*a*, 405*b* have sloped lower ends, the insert 400 glides smoothly along the guiding slots 104*a*, 104*b* without much force needed. Because the legs 404 are joined to the main plate 401 with a living hinge portion and extend upward from the living hinge, the force used to press the insert downwards is easily transferred into a lateral force to move the legs inwards compared to the case where the legs extend downwards from the living hinge.

When the insert 400 is fully inserted into the guiding slots 104*a*, 104*b*, the feet 405*a*, 405*b* on the legs 404*a*, 404*b* of the insert 400 engage with the engagement holes 501*a*, 501*b* on the drawer 100. At the same time, the protrusion 407 in the base 406 of the insert 400 engages with the notch 502 in the bottom surface of the drawer 100. Furthermore, the tapered ribs 408*a*, 408*b* of the insert 400 glide into and rest securely in the top ends of the guiding slots 104*a*, 104*b*. In this way, the insert 400 is rigidly held in the drawer 100. The user can then push more inserts into any of the other guiding slots to form compartments of desired size. The drawer 100 can be configured with same sized compartments, as shown in FIG. 3, or with compartments of variable sizes.

In the present embodiment, the insert 400 is made of the same material as the drawer 100 and is therefore rigid and does not deform with the weight of articles stored in the drawer 100. Once fully inserted, the resilient nature of the legs 404 makes it difficult for the anyone to remove the insert 400 by pulling it up from the top. Moreover, as the feet 405 have a flat top, they sit firmly in the engagement holes 501 and do not disengage easily. Because the legs 404 extend upwards from the living hinge and end in the flat surface, any force exerted to remove the insert 400 is transmitted downwards through the length of the legs 404 and does not act to move them inwards. Furthermore, as the tapered ribs 408 also rest firmly into the guiding slots 104 due to their shape, they also resist any unintentional movement of the insert 400. Therefore, with the presence of engagement features (legs 404, feet 405, and tapered ribs 408) and the overhang on the insert 400, it is extremely difficult for anyone to simply pull the insert 400 out of the drawer 100.

Figure 7:
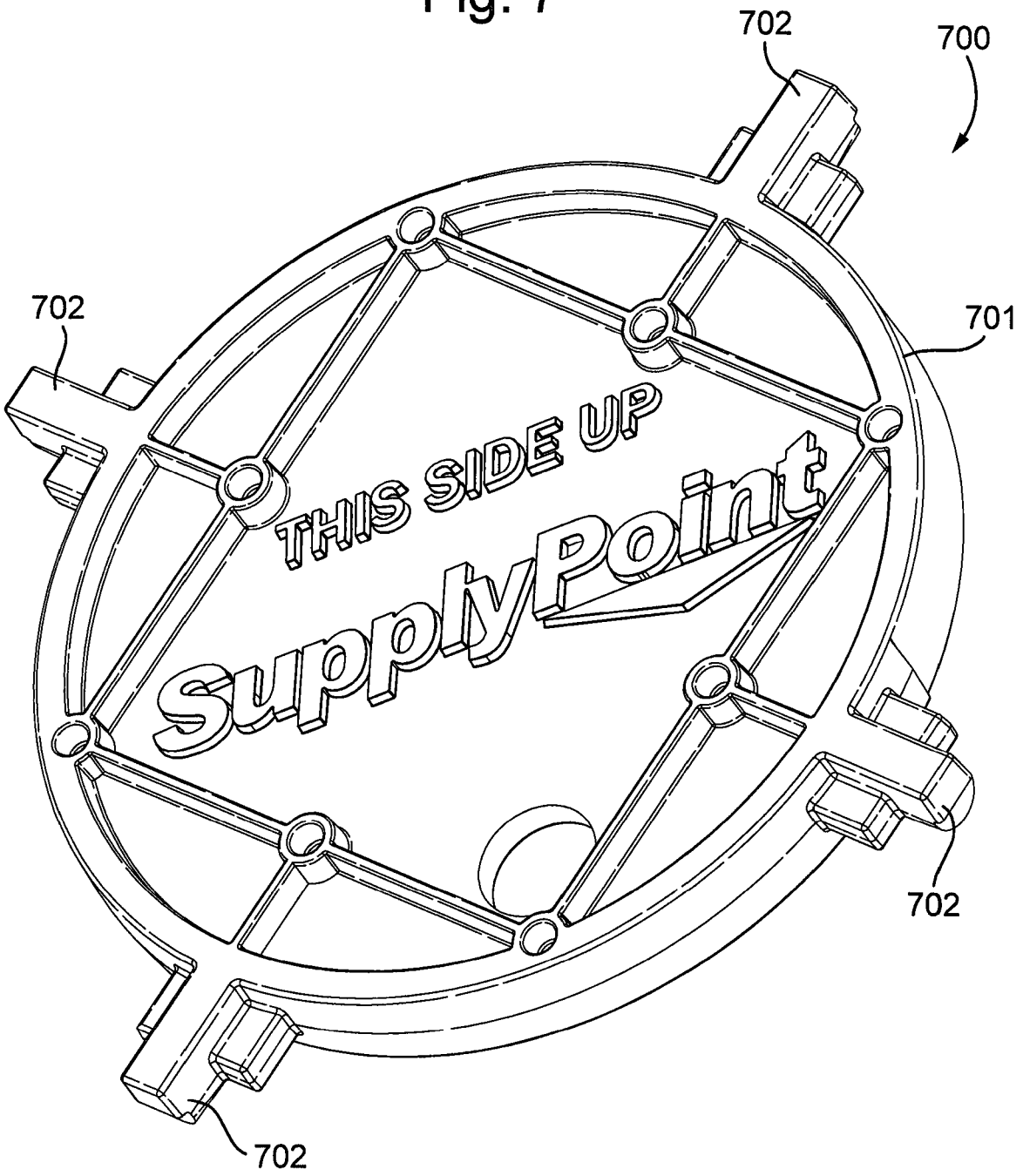
FIG. 7 is a perspective view of an insert removal tool according to the present invention.

FIG. 7 shows a perspective view of a removal tool 700 according to the present invention. The removal tool 700 aids the removal of the insert 400 from the drawer 100. In the present embodiment, the removal tool 700 comprises a substantially circular plate 701 with four protruding elements 702 extending outwards from the circumference of the plate 701. However, it is to be understood that the removal tool 700 can be of any shape and can have one or more protruding elements 702. Each protruding element 702 is shaped and dimensioned such that it matches the outside of the engagement holes 501 in the drawer 100.

Referring now to FIGS. 6 and 7, to remove the insert 400 from the drawer 100, an authorised user holds the removal tool 700 with the top face facing upwards. He then pushes any one of the protruding elements 702 orthogonally into the engagement hole 501*a* while pulling the insert 400 upwards from the top. As the protruding element 702 exerts pressure on the leg 404*a*, it bends inwards thereby forcing the feet 405*a* to disengage from the engagement hole 501*a*. The user then repeats this operation on the other side of the drawer 100 to disengage the feet 405*b* from the engagement hole 501*b*, while continuing to pull the insert 400 upwards. Once both feet 405*a*, 405*b* are disengaged from the engagement holes 501*a*, 501*b*, the user easily pulls out the insert 400 from the notch 502 and thereby removes it from the guiding slots 104*a*, 104*b*. It is to be understood that it is necessary for the user to forcibly pull the insert 400 upwards while pushing the removal tool 700 into the engagement holes 501 as otherwise the legs 405 would re-engage with the engagement holes 501 due to the resilience of the legs 404.

In another embodiment, the user could use two removal tools 700 at the same time to remove the insert 400 from the drawer 100. To disengage the feet 405*a*, 405*b* from the engagement holes 501*a*, 501*b*, the user pushes each of the two removal tools 700 into the engagement holes 501*a*, 501*b* simultaneously. The design of the removal tool 700 is such that when the feet 405*a*, 405*b* disengage, the insert 400 automatically pops up from the guiding slots 104*a*, 104*b*. In this way, the user can easily remove the insert 400 from the drawer 100 without having to hold the insert 400 while pushing the removal tool 700 to release the other feet.

In the present invention, the insert 400 is further provided with the guidance notch 410 in the top of and to the left-hand side of the insert 400. A corresponding projection is formed to extend substantially longitudinally along the bottom of the drawer 100 directly below the notch 410, thereby forming a guidance rail 603 (shown in FIG. 6). The guidance rail 603 is sized to fit in the notch 410. Accordingly, when the drawer 100 is mounted to the cartridge 200 in a stacked arrangement, the guidance rail 504 of an upper drawer 100 is disposed in the guidance notch 410 of the insert 400 held in a lower drawer 100. This arrangement provides guidance for the drawers 100 as they are opened and closed and stops them from becoming skewed.

In a preferred embodiment, the bottom of an upper drawer 100 rests on the top of a lower drawer 100 and/or the bottom of the guidance rail 603 rests on the bottom of the notch 410 as the drawer 100 is pulled out. Alternatively, upper drawers 100 may rest on lower drawers 100 at all times. However, neither case is essential and the full weight of the drawers 100 may always be supported by the guide block 205 alone, for example.

Those skilled in the art will recognise that the drawer of the present invention has a wide variety of different applications, from medical and manufacturing facilities of all different sizes to simple coin-operated vending machines. The drawer with guiding slots and inserts could also be used in simple storage units at home.

The use of insert 400 in the drawers 100 in this manner provides significant advantages in terms of flexibility and convenience. For example, if it is desired to use the drawer 100 with different compartment sizes, all that is required is to slide one or more inserts 400 into the guiding slots 104 to form compartments of desired sizes. Moreover, as the insert 400 is held rigidly in the guiding slots 104, there is no risk of articles being mixed by bending or falling of the insert 400. Furthermore, as the insert 400 cannot be easily pulled out from the top, the drawer arrangement cannot be tampered with. Only an authorised person in possession of the removal tool 700 would be able to withdraw the insert 400 and re-configure the drawer when needed. This is particularly advantageous when the drawer is used in a vending machine to prevent an external user from tampering with the insert to gain unauthorised access to articles stored in otherwise inaccessible compartments at the back of the drawer.

The arrangement in which, when the drawer 100 is mounted to the guide block 205, the sensors 201, 202 and the projections 108 are disposed between the upper and lower rails is advantageous in providing consistently accurate determination of the position of the drawer 100.

In particular, since the projections are moulded into the drawer 100 there is no need to add an additional component to act as drawer information means. By an alternating arrangement of projections 108 and gaps 109 in the drawer 100 it is possible to achieve the function of a raster strip that would otherwise be mounted on the drawer 100, thus reducing the costs and complexity of the system and improving accuracy. Accordingly, despite the relative complexity and high degree of functionality of the drawer 100, it can be manufactured cheaply and accurately with low tooling set-up and maintenance costs. This provides a significant competitive advantage.

The foregoing description has been given by way of example only and it will be appreciated by a person skilled in the art that modifications can be made without departing from the scope of the present invention.

The insert in the preferred embodiment has two legs, one on either side of the plate. However, this is not essential. Instead, the insert may have only one leg so one side is not provided with a leg. Alternatively, two or more legs may be provided on either or both sides.

In the foregoing description, the use of the guidance rail 603 and the guidance notch 410 is optional, as is the protrusion 407 and corresponding notch 602. Moreover, their respective positions in the width direction can be varied. Furthermore, more than one protrusion and corresponding notch can be provided for larger drawers.

The latching mechanism described above uses a solenoid 203 and a solenoid flap 204. However, the person skilled in the art will recognise that many other latching mechanisms could be used, whether with or without a solenoid. Where a solenoid is used, the particular arrangement described is not necessary.

The sensing arrangement has been described as detecting the home position of the drawer 100 directly, as well the speed and the direction of movement of the drawer 100 based on the speed and pattern of detection signals output by the light receivers 202. In this way, the position of the drawers 100 can be detected. However, other arrangements are also possible. For example, the sensing arrangement may be able to directly detect a position of each compartment in the same way as the home position, or by detecting the number of times the or each light receiver is activated. It will be clear that different numbers of sensors and different layouts of projections may become appropriate depending on the precise implementation.

The precise arrangements of the upper and lower rails and the upper and lower rail-engagement portions can also be varied. For example, both the upper and lower rail-engagement portions can be provided on the side of the drawer 100. Also, the upper and lower rail-engagement portions can be provided on the guide block 205 and the upper and lower rails can be provided on the drawer 100. Different numbers of these parts can also be provided. Similarly, the positional relationship between the sensors, rails, rail-engagement portions and index members can also be varied. For example, rail-engagement portions could be provided on both sides of the drawer and projections could be provided adjacent the lower rail-engaging portion instead of the upper rail-engaging portion. The projections could also extend downwards from the bottom of the drawer.

The foregoing description of illustrated embodiments of the present invention, including what is described in the abstract, is not intended to be exhaustive or to limit the invention to the precise forms disclosed herein. While specific embodiments of the invention are described herein for illustrative purposes only, various equivalent modifications are possible within the spirit and scope of the present invention, as those skilled in the relevant art will recognize and appreciate. As indicated, these modifications may be made to the present invention in light of the foregoing description of illustrated embodiments of the present invention and are to be included within the spirit and scope of the present invention.

The invention claimed is:

1. A drawer comprising:

a receptacle that is open at a top of the drawer;

at least one guiding slot extending longitudinally along an inner surface of a side wall of the drawer;

at least one engagement hole formed in the side wall of the drawer along the guiding slot; and at least one removable insert, the insert comprising:

a plate; and at least one leg integrally formed with the plate and extending longitudinally upwards along a side of the plate, wherein a side edge of the plate extends longitudinally downwards above the leg to form an overhang over the leg, wherein the insert is inserted into and held in the guiding slot and the leg engages with the engagement hole, whereby the insert divides the drawer into at least two compartments, wherein the side edge that forms the overhang over the leg is adapted to securely glide and rest in a top end of the guiding slot, and wherein the side edge of the overhang is thicker than the plate and is tapered.

2. A drawer according to claim 1, wherein the insert comprises:

a pair of legs formed in a body of the plate and extending longitudinally upwards along sides of the plate and side edges of the plate extend longitudinally downwards above the legs to form an overhang over each of the legs, and the drawer comprises a corresponding number of guiding slots.

3. A drawer according to claim 1, wherein the at least one leg is sprung so as to bend inwards to aid insertion of the insert into guiding slots formed in a body of the drawer.

4. A drawer according to claim 3, wherein the legs extend up to mid-way along the length of either side of the plate.

5. A drawer according to claim 1, wherein the insert further comprises at least one protrusion extending outwards from a base of the plate.

6. A drawer according to claim 5, wherein the protrusion is adapted to engage with a notch, provided on the bottom surface of the drawer, when the plate is inserted into guiding slots.

7. A drawer according to claim 1, wherein the at least one leg further comprises a foot portion to engage with the engagement hole, the foot portion having a flat top and a sloped lower end.

8. A drawer according to claim 1, wherein the insert is adapted to be removed from the drawer by guiding a removal means into the engagement holes so as to disengage the legs from the engagement holes.

9. A drawer according to claim 1 further comprising:

a drawer information means extending in a depth direction of the drawer, wherein the drawer information means comprises a series of projections molded into the drawer and a series of gaps formed between consecutive projections.

10. A drawer according to claim 9, wherein the drawer information means is disposed between an upper and a lower-rail engaging means provided in a first side of the drawer.

11. A drawer according to claim 10, wherein the drawer information means is disposed adjacent to the upper rail-engaging means.

12. A drawer according to claim 9, wherein the drawer and the projections are injection molded as one single unit.

* * * * *